US008286276B1

(12) United States Patent
Cerda

(10) Patent No.: US 8,286,276 B1
(45) Date of Patent: Oct. 16, 2012

(54) POOL OR SPA COVER SEALING AND SUPPORT ON WATER RECEPTACLE HAVING WATERFALL CHUTE

(75) Inventor: Robert Cerda, Escondido, CA (US)

(73) Assignee: Softub, Inc., Poway, CA (US)

( * ) Notice: Subject to any disclaimer, the term of this patent is extended or adjusted under 35 U.S.C. 154(b) by 338 days.

(21) Appl. No.: 12/590,264

(22) Filed: Nov. 6, 2009

(51) Int. Cl.
*E04H 4/00* (2006.01)

(52) U.S. Cl. ..... 4/498

(58) Field of Classification Search ..... 4/498, 488, 4/507, 509; 210/629; 417/278
See application file for complete search history.

(56) References Cited

U.S. PATENT DOCUMENTS

| | | | | |
|---|---|---|---|---|
| 4,422,193 | A * | 12/1983 | Kravath | 4/505 |
| 5,249,744 | A * | 10/1993 | Ruthenberg | 239/23 |
| 6,196,471 | B1 * | 3/2001 | Ruthenberg | 239/18 |
| 6,367,100 | B2 * | 4/2002 | Koren et al. | 4/507 |
| 6,375,342 | B1 * | 4/2002 | Koren et al. | 362/562 |
| 6,382,520 | B1 * | 5/2002 | Hones | 239/12 |
| 6,484,952 | B2 * | 11/2002 | Koren | 239/18 |
| 6,578,774 | B1 * | 6/2003 | Noyes | 239/17 |
| 6,595,675 | B2 * | 7/2003 | Dongo | 362/562 |
| 7,162,752 | B2 * | 1/2007 | McDonald et al. | 4/507 |
| 7,200,879 | B2 * | 4/2007 | Li et al. | 4/507 |
| 7,472,430 | B2 * | 1/2009 | McDonald et al. | 4/507 |
| 7,654,471 | B2 * | 2/2010 | Johnson | 239/193 |
| 7,815,329 | B2 * | 10/2010 | Scali et al. | 362/96 |
| 2005/0086733 | A1 * | 4/2005 | Li et al. | 4/507 |
| 2005/0167347 | A1 * | 8/2005 | Thomas | 210/170 |
| 2006/0021128 | A1 * | 2/2006 | Li et al. | 4/507 |
| 2006/0042689 | A1 * | 3/2006 | Hinojosa | 137/137 |
| 2006/0101570 | A1 * | 5/2006 | Kunkel | 4/507 |
| 2006/0218718 | A1 * | 10/2006 | Deboer et al. | 4/596 |
| 2007/0063065 | A1 * | 3/2007 | Barnhill | 239/16 |
| 2007/0107117 | A1 * | 5/2007 | Casolco | 4/496 |
| 2007/0245480 | A1 * | 10/2007 | Sorensen et al. | 4/509 |
| 2008/0094821 | A1 * | 4/2008 | Vogtner | 362/101 |
| 2009/0218411 | A1 * | 9/2009 | Hansen | 239/1 |
| 2010/0132108 | A1 * | 6/2010 | Rudi | 4/509 |
| 2010/0170959 | A1 * | 7/2010 | Kelly et al. | 239/17 |

* cited by examiner

*Primary Examiner* — Lori Baker
(74) *Attorney, Agent, or Firm* — William W. Haefliger

(57) ABSTRACT

A pool or spa cover adapted for use with a waterfall chute projecting from the top edge of a pool or spa water receptacle, comprising in combination, the cover having sections hinge connected to allow one section to pivot downwardly toward the waterfall chute while the other section remains peripherally seated on the receptacle, the one section having edge portions adapted to seat on receptacle edge portions at opposite sides of the chute, the one section locally configured to accommodate the cover to the chute as the cover pivots downwardly to seat on the pool or spa receptacle top edge.

19 Claims, 6 Drawing Sheets

FIG. 4
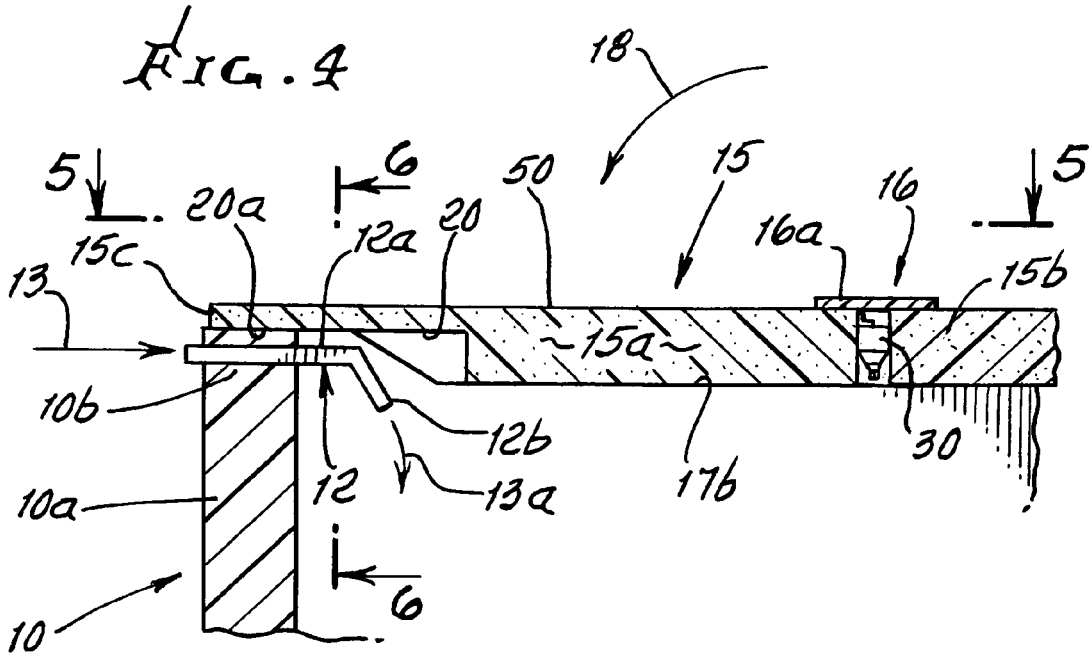
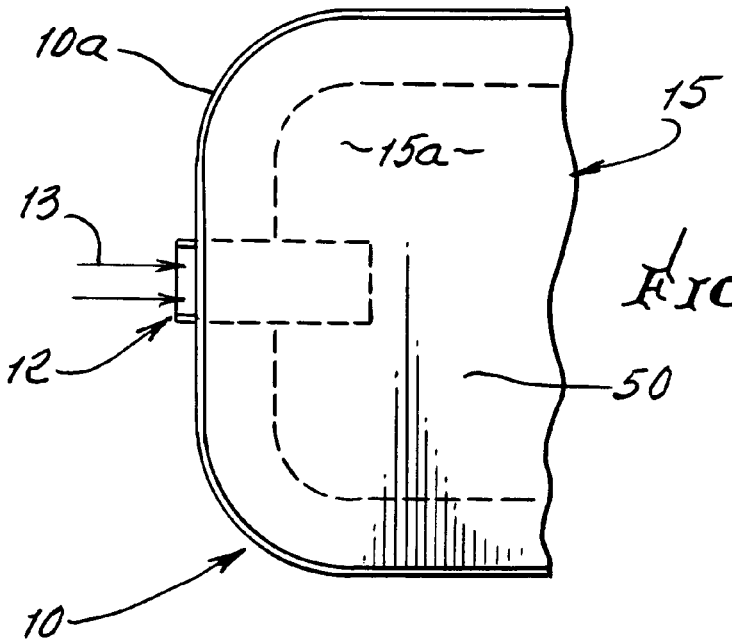
FIG. 5

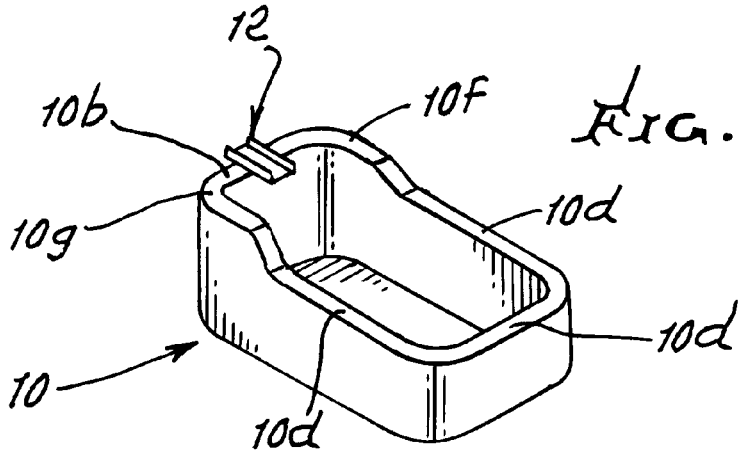
FIG. 9
FIG. 10
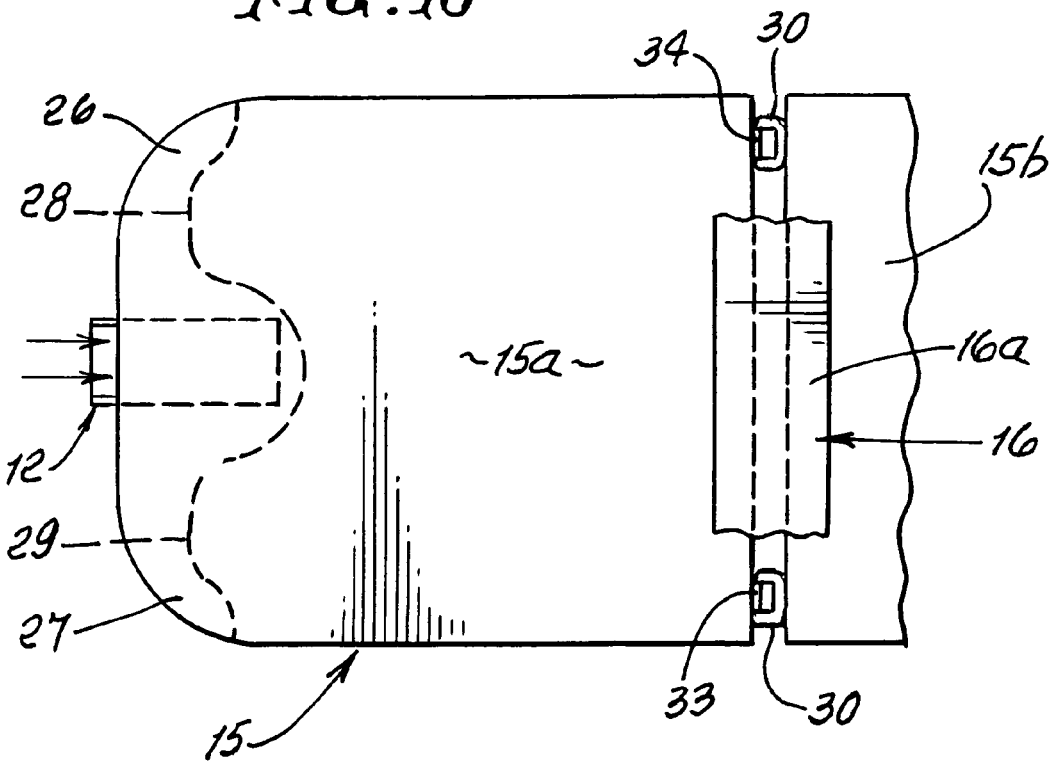

POOL OR SPA COVER SEALING AND SUPPORT ON WATER RECEPTACLE HAVING WATERFALL CHUTE

BACKGROUND OF THE INVENTION

This invention relates generally to pool or spa covers, and more particularly to covers configured to accommodate to waterfall chutes.

At present, spas or pools are frequently provided with waterfall chutes. Such chutes typically project over the open water containing interior of the pool or spa, from a location spaced above the level of the side wall of the spa or pool, in order to provide for the effect of water falling from a height. This presents the problem of configuring the pool or spa cover so as to easily seat or seal on the top of the side wall, when placed over the spa or pool interior. In an effort to overcome this problem, pads or padding have been attached to the underside of the cover, as near its edge, to provide for seating or sealing; however, such padding is bulky and adds to the difficulty of maneuvering the cover so as to align with, seat on and seal upon pool or spa edges. There is need for improvements to enable ease and assured seating and sealing of pool covers on pool or spa upper edges, particularly where waterfalls are employed.

SUMMARY OF THE INVENTION

It is a major object of the invention to provide simple, desirable, and effective improvements in covers adapted to pools or spas incorporating waterfall devices.

Basically, and as will be seen, the invention embodies a pool or spa cover adapted for use with a waterfall chute projecting from the top edge of a pool or spa water receptacle, comprising in combination:

a) the cover having sections hinge connected to allow one section to pivot downwardly toward the waterfall chute while the other section remains peripherally seated on the receptacle, b) the one section having edge portions adapted to seat on receptacle edge portions at opposite sides of the chute, and at elevated locations, c) the one section locally configured to accommodate the cover to the chute as the cover pivots downwardly to seat on the pool or spa top edges.

As will be seen, the cover typically consists of synthetic foam to seal downwardly against the upper edge extent of the receptacle, and in proximity to the chute. In this regard, the chute itself may project from edge extent of the receptacle toward the open interior of the receptacle. That edge extent of the receptacle proximate the chute may be raised so that water delivered by the chute falls as from a waterfall height, providing waterfall effect, and so that sealing of the cover to the receptacle top edge, proximate the chute, is not compromised.

A further object is to provide the cover with a locally cut-away portion, as at the underside of a hinged section of the cover, that cut-away registering with the chute, and wherein the one section has a peripheral portion that seats on the receptacle edges proximate the chute.

Further, the cut-away typically has a boundary that is convex toward a hinge connecting said sections, whereby the cut-away accommodates to the projecting extent of the chute.

In this regard, a portion of the cover overlapping the cut-away may then seal and seat against the pool or spa side wall upper edges, proximate the chute, to provide a smooth, totally covering appearance of the cover. Further, the portion of the pool or spa side wall supporting the chute and adjacent seated covers extent is typically elevated relative to the main extent of the pool or spa.

A yet further object is to provide wedge shaped pads loosely suspended and interposed between cover section edges below a hinge connecting the section, to seat against such edges as the one section pivots downwardly toward the chute, to relatively position the cover sections.

Further, the cover may have self adjustable alignment padding between transverse cover end portions, to assure alignment of a downwardly closable cover section relative to waterfall structure.

These and other objects and advantages of the invention, as well as the details of an illustrative embodiment, will be more fully understood from the following specification and drawings, in which:

DRAWING DESCRIPTION

FIG. 4 is a view like FIG. 2, but showing the spa cover in closed position, embracing the waterfall chute;

FIG. 5 is a plan view taken on lines 5-5 of FIG. 4;

Figure 8:
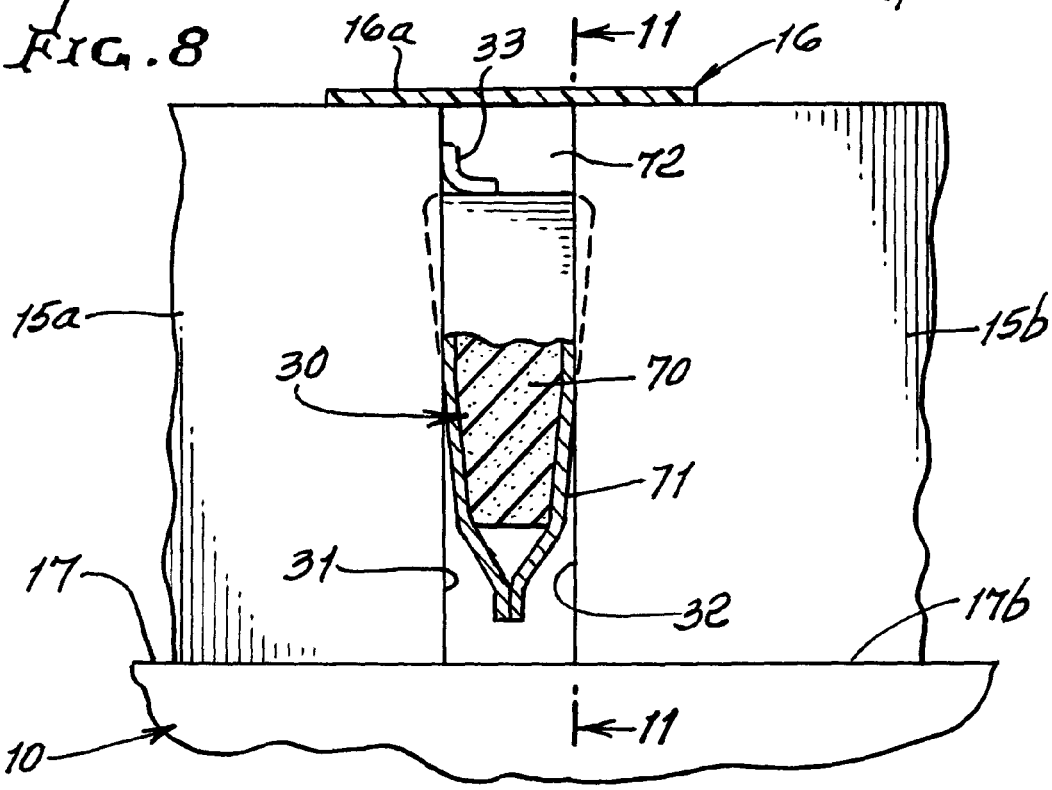
FIG. 8 is an enlarged section showing a self positioning located pad received between cover sections, at a hinge location.
Figure 11:
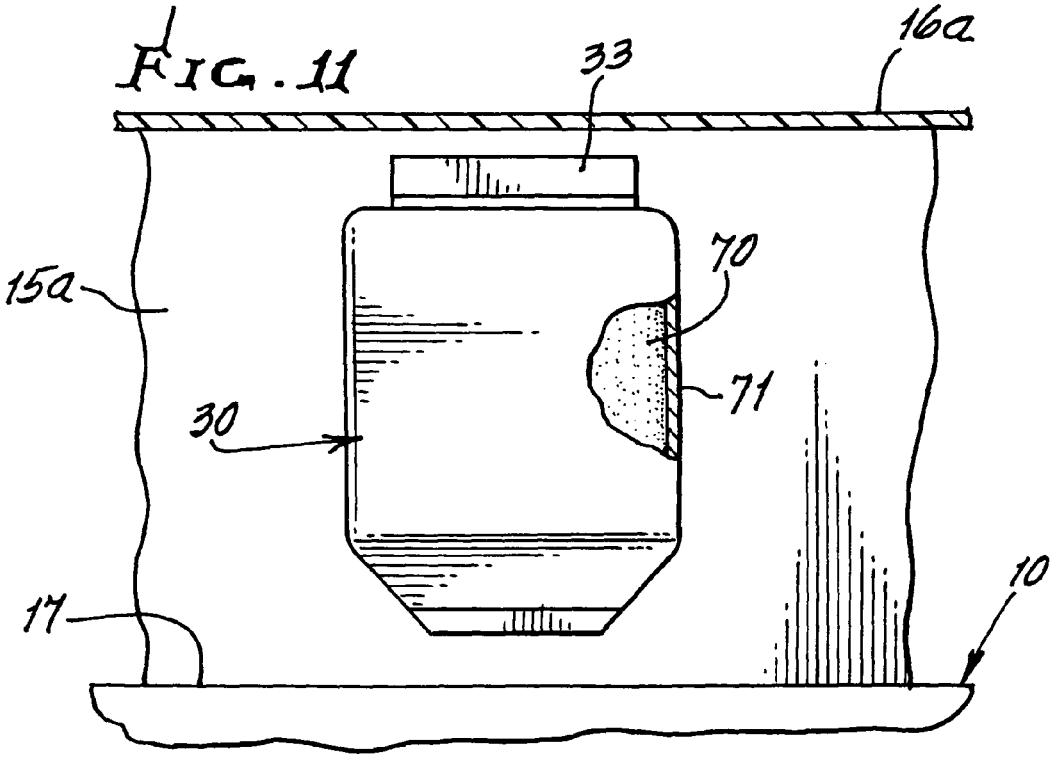

FIG. 9 is a perspective view of a spa, with a raised end wall, to accommodate waterfall raised positioning relative to water level in the spa; and FIG. 10 is a top plan view of two self adjustable, flap-hinge connected covers, with pads or padding between transverse end portions thereof, acting to align the downwardly closable section, relative to a waterfall; and FIG. 11 is an elevated taken on lines 11-11 of FIG. 8.

Figure 12:
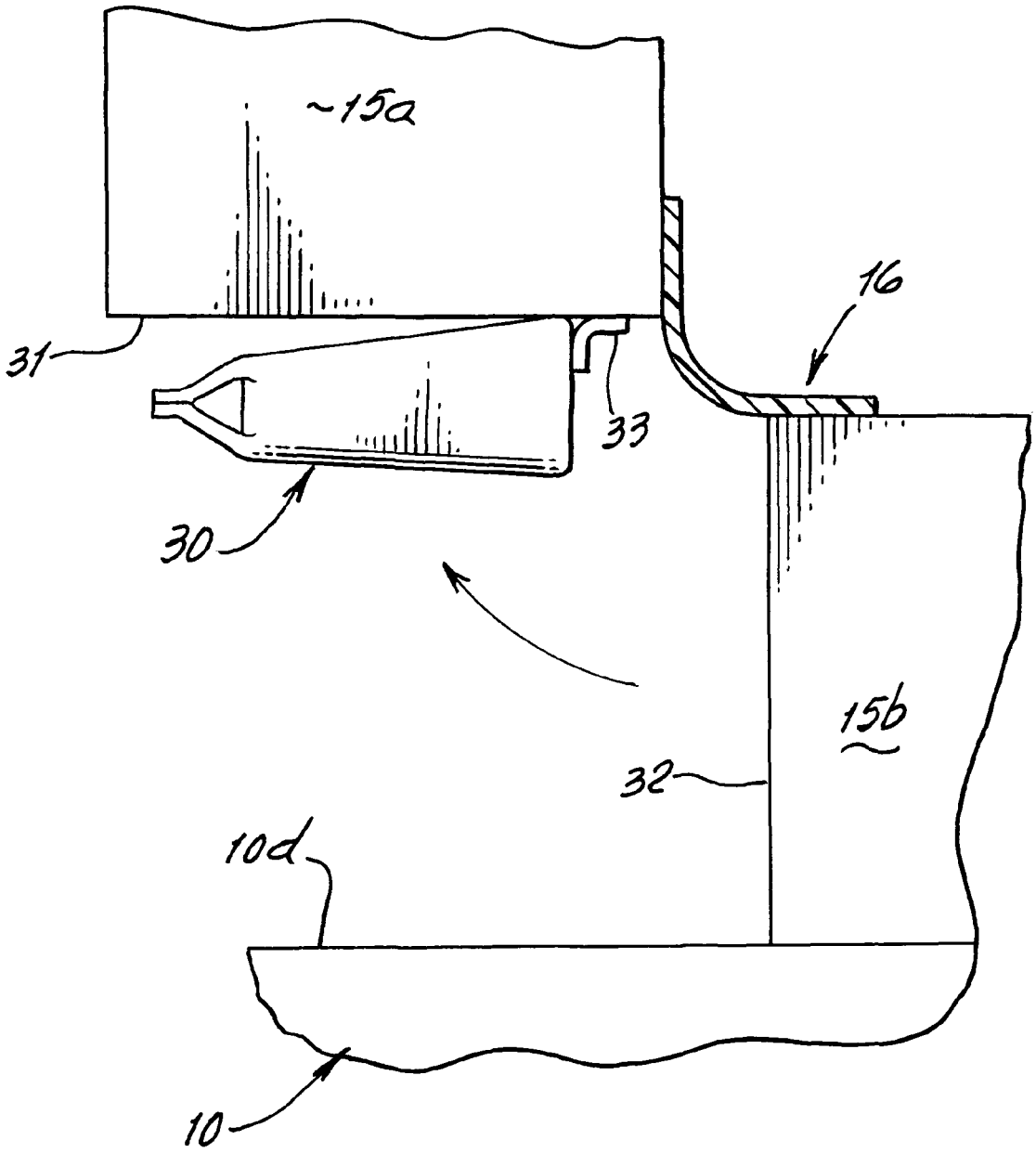

FIG. 12 is a vertical section showing lifting of a cover section away from padding between the sections.

DETAILED DESCRIPTION

Referring first to FIGS. 1, 4, 5 and 9, they show a spa unit 10 defining a receptacle 10*a* to receive water, as in a pool 11. A waterfall chute or conduit 12 is carried at the top of receptacle side wall section 10*b*, the chute projecting at 12*a* close to the top of the wall, and inwardly and downwardly at 12*b* over the water pool 11.

Figure 1:
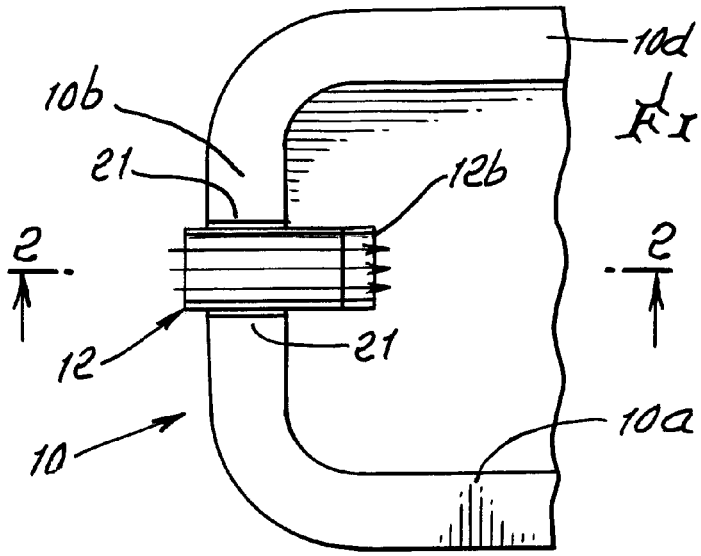
FIG. 1 is a plan view of a spa receptacle wall showing waterfall structure.
Figure 3:
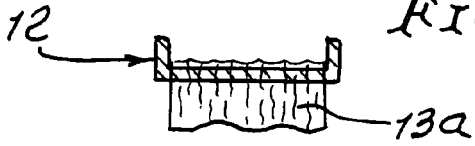
FIG. 3 is an enlarged section taken on lines 3-3 of FIG. 2.

A waterfall effect is provided by the width of the chute, see in FIGS. 1 and 3. Arrows 13 and 13*a* indicate the path of the water flowing in the chute and into the pool. Side wall section 10*b* typically extends upwardly to an elevation above the level of the major extent of the remainder of the receptacle side wall so that the free drop of the water is extended, for waterfall effect. See raised end wall or section 10*b* in FIG. 9, and the relatively lower elevation of the receptacle remaining side wall extent at 10*d*.

Figure 2:
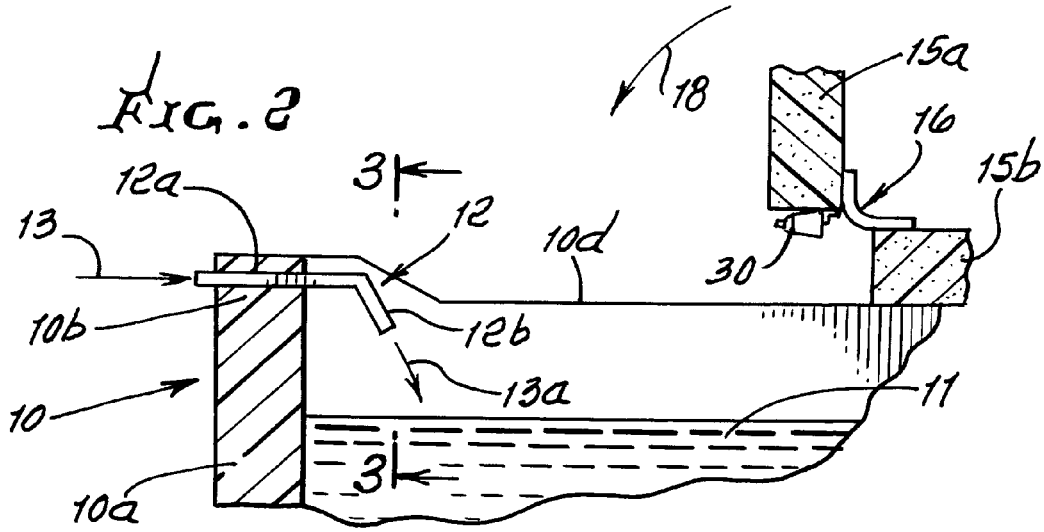
FIG. 2 is an enlarged section taken in elevation on lines 2-2 of FIG. 1, with cover section in raised position.
Figure 6:
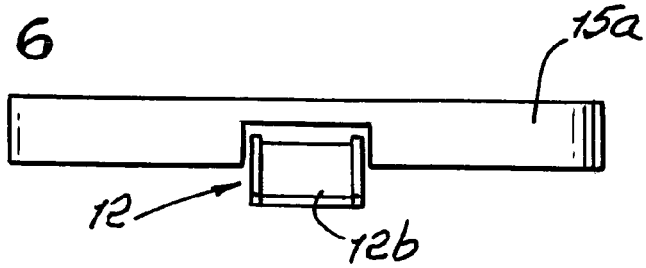
FIG. 6 is a section taken in elevation on lines 6-6 of FIG. 4.

Referring to FIGS. 4, 5 and 6, a receptacle cover 15 is provided to have two sections 15*a* and 15*b*, typically hinge connected at 16 as by a layer 16*a* of flexible plastic material allowing up and down pivoting of section 15*a* relative to section 15*b*. FIG. 2 shows section 15*a* pivoted upwardly relative to section 15*b*, as during application of the cover to the receptacle. In FIG. 4, section 15*a* is shown seated on the relatively lower elevation upper edge 17 of the receptacle. Cover section 15*a* is to be pivoted or to swing downwardly (see arrow 18 in FIG. 2) to a lowered position, as seen in FIG. 4, at which time edge portion 15*c* of 15*a* closes toward the chute to seat on the upper edge or edges 20*a* of the receptacle wall sidewardly, spaced from the chute. See FIG. 4.

In accordance with an important aspect of the invention, the cover one section 15*a* is locally configured to accommodate to the relatively raised positioning of the waterfall chute, as the cover pivots downwardly to seat on the receptacle elevated upper edges nearest the chute. As shown, the cover section 15*a* is locally cut-away or recessed at 20 at its underside, near the cover end 15*c*, to come into vertical registration with the chute, as seen in FIG. 4, as the cover section is lowered. The underside 20*a* of the recessed portion then seats on the top edges of raised end wall portion of the receptacle, as at 21, at laterally opposite sides of the chute, so that water may freely flow in the raised chute, below cover underside 20*a*.

In this regard, the cover sections 15*a* and 15*b* typically consist of molded synthetic foam, to seal as well as seat on the spa receptacle side wall upper edges 17*b* and at 21. The configuration of the cover section 15*a*, including its underside recessing, is such as to provide a smooth, spa and chute covering top external appearance of the seated and down-pivoted cover, as at 50.

Figure 7:
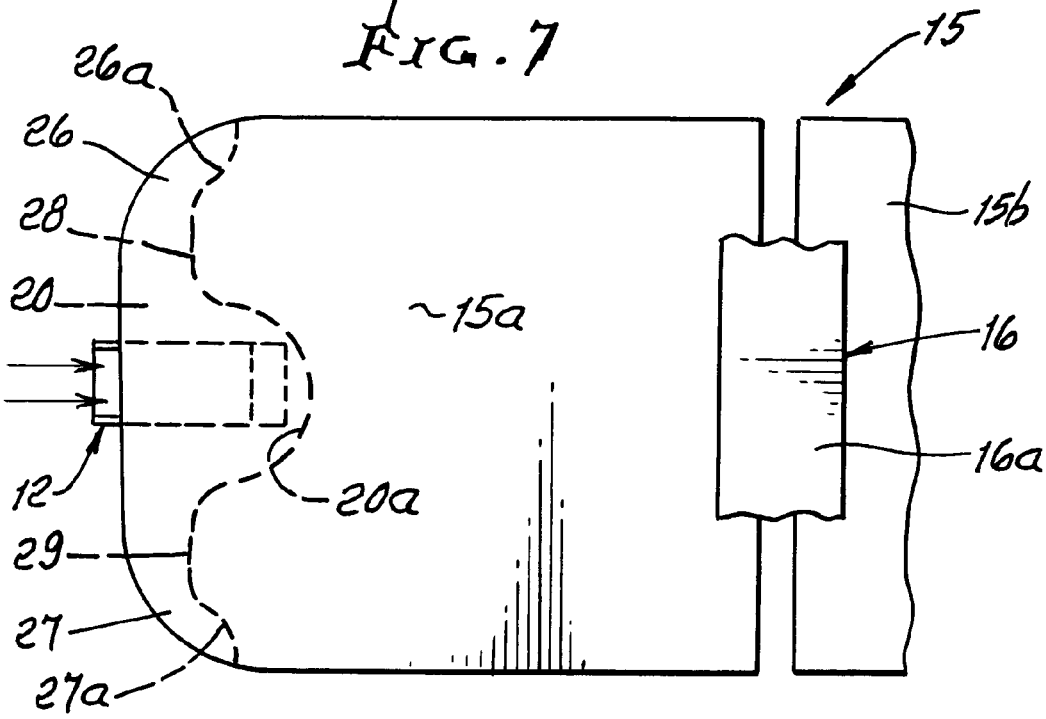
FIG. 7 is a plan view of a cover section showing cut out configuration extended to opposite ends of the section to receive receptacle raised lateral end portions.

FIG. 7 shows lateral extensions at 26 and 27 of the recess or cut-away, to vertically accommodate the cover to relatively raised lateral extents of the receptacle wall, seen at 10*f* and 10*a* in FIG. 9. This configuration minimizes any flexing of cover section 10*a* particularly downwardly at those locations, despite pivoting "lay-down" of the section 10*a* onto the receptacle. Note in FIGS. 7 and 10 the laterally sequential triple arcuate extents of the end walls 20 onto the receptacle. Note the laterally sequential triple arcuate extents of the end walls 20*a*, 26*a* and 27*a*. Lateral or transverse stiffness of the cover section 15*a* is preserved by the arcuately extending recess end walls 28 and 29, projecting endwise oppositely relative to recessed end walls 20*a*, 26*a* and 27*a*, in FIG. 7.

FIGS. 2, 4, 8 and 9 show provision of shaped padding 30 positioned between proximate ends or end walls 31 and 32 of the cover sections 15*a* and 15*b*, at the hinging location. That padding is loosely supported as by straps 33 and 34 connected to one of the cover sections, as seen in FIGS. 8 and 10, whereby the padding dangles freely to self-adjust while compressed between end walls 31 and 32 as they are relatively displaced toward one another during pivoting of cover section 15*a* to downward position, as seen in FIGS. 4 and 8. The padding typically has wedge shape, vertically, so as to facilitate squeezing into self-adjusted positions, holding the cover sections in adjusted positions and also permitting some adjusting relative movement, laterally, during cover application to the receptacle, bringing the recess 20 into registration with the waterfall chute. Connection strap 16*a* flexes to cooperate with such cover section self adjusting, the padding 30 variably compressing sufficiently to maintain strap 16*a* smoothly extended at the cover section surfaces.

From the foregoing, it will be seen from FIGS. 8-12 that each of the two pads 30 comprises a wedge shaped, resiliently compressible body 70, and a thin flexible cover layer or layers 71 fitted closely over the body to firmly contain it as the pad is sidewardly compressed between walls 31 and 32, as the spa cover section 15*a* is lowered into seated and heat sealing position. See FIG. 8. Free suspension of the pads is provided by straps or holders 33 and 34. This is facilitated by compressible self-adjustment of the pads, and by alignment of the sections 15*a* and 15*b*, effected by the cover strap or layer 16*a*, smoothly tensioned over the gap 72 between the sections in response to resilient compression of the pads. As a result, section 15*a* accurately seats downwardly on the receptacle upper edge 17, and relative to the waterfall chute. To this end, each pad preferably tapers downwardly and has opposite sides compressed by and between said section walls or, thereby to position the one section 15*a*, aligning it horizontally relative to the chute as the cover is closed downwardly. The hinge 16*a* flexible material (preferably consisting of synthetic resinous material) overlying the gap 72, acts to block upward escape of heat from spa water, the pads located in said gap.

A very effective heat sealing combination is thereby provided, is such a way that horizontally accurate downward seating of section 15*a* on the receptacle edges 17 is assured, the wedge shaped pads tensioning the hinge connection 16 when the section 15*a* is closed downwardly and compressively engages and resiliently compresses the wedge shaped pads. Resilient compression progresses downwardly at the pad sides as the walls 31 and 32 progressively engage and compress the pad downwardly tapering opposite sides, to progressively cushion closing of the cover section 15*a* relative to the edge 17.

I claim:

1. A pool or spa cover and a waterfall chute projecting from the top edge of a pool or spa water receptacle, comprising in combination:

a) the cover having sections hinge connected to allow one section to pivot downwardly toward the waterfall chute while the other section remains peripherally seated on the receptacle, b) said one section having an edge portion or portions located to seat on receptacle edge portions at opposite sides of the chute, and which extend away from the chute and about the pool, c) said one section locally configured to accommodate the cover to the chute as the cover pivots downwardly to seat on the pool or spa receptacle top edge.

2. The combination of claim 1 wherein the cover consists of synthetic foam to seal downwardly against the upper edge extent of the receptacle, and in proximity to the chute.

3. The combination of claim 2 wherein the chute projects from edge extent of the receptacle toward the open interior of the receptacle.

4. The combination of claim 1 wherein the cover is locally cut away at the underside of said one section, registering with the chute, whereby said one section has a peripheral portion that seats on the receptacle edge proximate the chute.

5. The combination of claim 4 wherein said local cut-away has a boundary that is convex toward a hinge connecting said sections, whereby the cut-away accommodates to the projecting extent of the chute.

6. The combination of claim 5 wherein a portion of the cover overlapping the cut-away may then seat or seal on the spa or pool side wall upper edge proximate the chute to provide a smooth, covering appearance of the seated cover.

7. The combination of claim 5 wherein the portion of the pool or spa side wall supporting the chute is elevated relative to the main extent of the pool or spa.

8. The combination of claim 1 including wedge shaped pads loosely suspended and interposed between section edges below a hinge connecting said sections, to seat against said edges as the one section pivots downwardly toward the chute, to relatively position the sections.

9. The combination of claim 1 wherein said one section also has local peripheral cut-outs to accommodate to receptacle upward projections spaced at opposite sides of, and from the chute.

10. In spa apparatus having a water receptacle with a side wall and a hinged cover with one section to be lowered to seat on said side wall, the combination comprising:

i) padding positioned between proximate ends of the cover sections to relatively position the sections in closed position, ii) said padding configured to be self adjustable and provide cushioning as the sections are relatively closed together.

11. The combination of claim 10 wherein the padding is at opposite lateral ends of the sections, to self adjust and thereby align the cover over the receptacle wall during closing.

12. The combination of claim 10 wherein said one section is cut-away to vertically register with a waterfall chute carried by the sidewall.

13. The combination of claim 8 wherein each of said pads comprises a generally wedge shape resiliently compressible body and a thin flexible cover fitting over said body.

14. The combination of claim 13 including a flexible holder attached to said cover and configured to be supported by one of said sections to freely suspend the pad between said edges.

15. The combination of claim 10 wherein said padding comprises a generally wedge shaped resiliently compressible body and a thin flexible cover fitting over said body.

16. The combination of claim 15 including a flexible holder in the form of a strap attached to said cover and configured to be supported by one of said sections to freely suspend the pad between said edges.

17. For use in spa apparatus having a water receptacle with a side wall and a hinged cover with one section to be lowered to seat on said side wall, the combination comprising:

i) padding positioned between proximate ends of the cover sections to relatively position the sections in closed position, ii) said padding configured to be self adjustable as the sections are relatively closed together, iii) said padding comprising a wedge shaped resiliently compressible body and a thin flexible cover fitting over said body iv) and support structure attached to said cover and configured to be supported by one of said sections to freely suspend the pad between said edges, v) said padding tapering downwardly and having opposite sides compressed by and between said edges.

18. The combination of claim 13 wherein each pad tapers downwardly and has opposite sides compressed by and between said section edges, thereby to position the one section, aligning it horizontally relative to the chute as the cover is closed downwardly.

19. The combination of claim 18 wherein the hinge comprises flexible material overlying a gap formed between the sections, to block upward escape of heat from spa water, the pads located in said gap.

* * * * *